US007026802B2

(12) United States Patent
Gradinariu

(10) Patent No.: US 7,026,802 B2
(45) Date of Patent: Apr. 11, 2006

(54) REPLICA BIASED VOLTAGE REGULATOR

(75) Inventor: Julian Gradinariu, Colorado Springs, CO (US)

(73) Assignee: Cypress Semiconductor Corporation, San Jose, CA (US)

( * ) Notice: Subject to any disclaimer, the term of this patent is extended or adjusted under 35 U.S.C. 154(b) by 0 days.

(21) Appl. No.: 10/965,445

(22) Filed: Oct. 14, 2004

(65) Prior Publication Data

US 2005/0134242 A1 Jun. 23, 2005

Related U.S. Application Data

(60) Provisional application No. 60/531,911, filed on Dec. 23, 2003.

(51) Int. Cl.
*G05F 3/16* (2006.01)

(52) U.S. Cl. ..... 323/316

(58) Field of Classification Search ..... 323/265, 323/266, 268, 271, 272, 282, 315, 316, 317
See application file for complete search history.

(56) References Cited

U.S. PATENT DOCUMENTS

| | | | | |
|---|---|---|---|---|
| 4,851,759 | A * | 7/1989 | Blauschild | 323/223 |
| 4,884,161 | A | 11/1989 | Atherton et al. | |
| 4,893,030 | A * | 1/1990 | Shearer et al. | 327/530 |
| 5,637,992 | A * | 6/1997 | Edwards | 323/315 |
| 6,157,176 | A | 12/2000 | Pulvirenti et al. | |
| 6,222,353 | B1 | 4/2001 | Pattamatta et al. | |
| 6,232,757 | B1 * | 5/2001 | Afghahi et al. | 323/314 |
| 6,373,231 | B1 | 4/2002 | Lacey et al. | |
| 6,522,111 | B1 | 2/2003 | Zadeh et al. | |
| 6,566,851 | B1 * | 5/2003 | Schuelke et al. | 323/315 |
| 6,879,142 | B1 * | 4/2005 | Chen | 323/316 |

* cited by examiner

*Primary Examiner*—Matthew V. Nguyen
(74) *Attorney, Agent, or Firm*—Bradley T. Sako

(57) ABSTRACT

A replica biased voltage regulator circuit (100) is disclosed that provides high frequency response via local positive feedback and low frequency response via a negative feedback loop. A voltage regulator circuit (100) can include current conveyor (106) that essentially forces an output voltage (Vload) to follow a replica voltage (Vrep). An operational amplifier (102) can provide negative feedback by controlling current supplied to the current conveyor (104) based on a comparison between a reference voltage (Vref) and the replica voltage (Vrep).

20 Claims, 7 Drawing Sheets

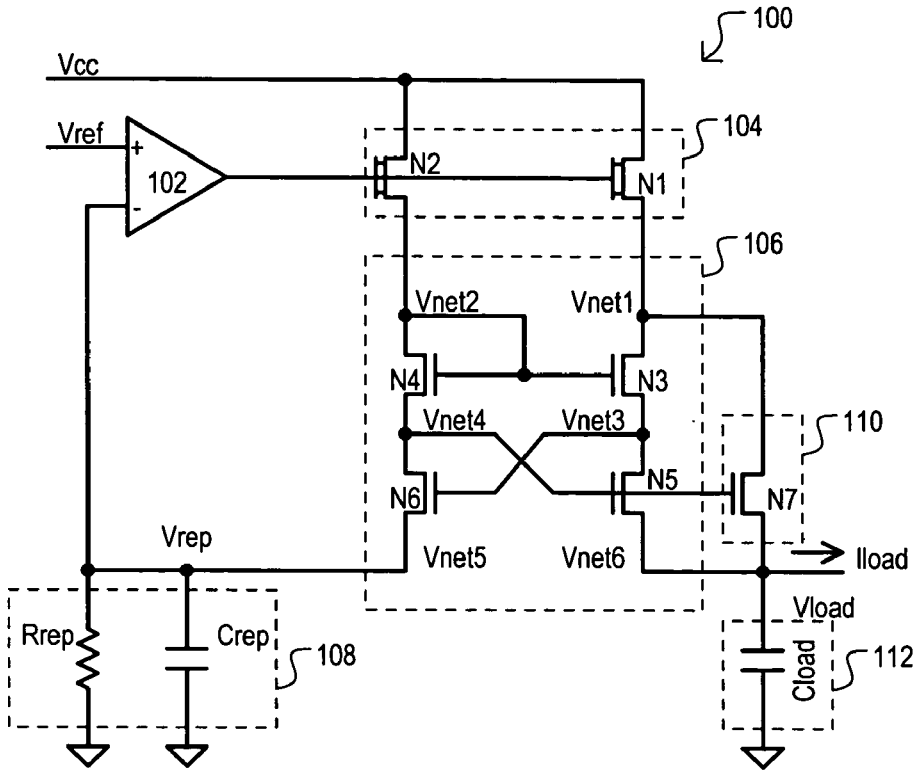
FIG. 1
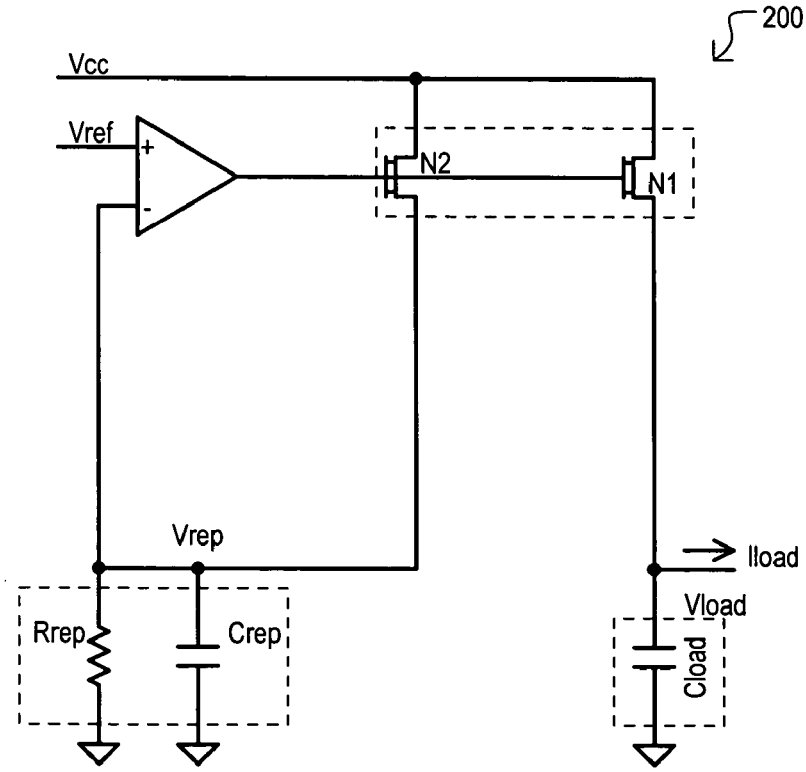
FIG. 2 (CONVENTIONAL MODEL)

REPLICA BIASED VOLTAGE REGULATOR

This application claims the benefit of U.S. provisional patent application Ser. No. 60/531,911, filed Dec. 23, 2003.

TECHNICAL FIELD

The present invention relates generally to voltage regulator circuits, and more particularly to replica biased voltage regulator circuits.

BACKGROUND OF THE INVENTION

Voltage regulator circuits can serve numerous purposes in integrated circuit devices. One particular application can be as a regulated internal power supply voltage for certain sections of an integrated circuit device. Even more particularly, voltage regulators can supply a power supply voltage to memory cell arrays within memory devices, such as dynamic random access memories (DRAMs) and static RAMs (SRAMs), as but two of the many possible applications.

Among the various types of voltage regulators are replica biased voltage regulators. Generally, in a replica biased voltage regulator a voltage established in one portion of a circuit (e.g., one leg), is replicated, typically by larger sized devices, to present a load (output) voltage. The load voltage is regulated by having it track the replica voltage as close as possible.

Prior art replica biased voltage regulators basically use active (dynamic) line regulation and passive (static) load regulation. Such approaches can achieve a good high-frequency transient response at the expense of poor DC load regulation.

In order to improve on DC load regulation and to prevent overshoots, either permanent or switched dummy loads have been proposed. Thus, existing replica biased voltage regulators have active (dynamic) line regulation and passive (static) load regulation. Various improvements have been proposed in order to better control output voltage over the load current range. These involve the use of fast voltage comparators in order to switch on/off dummy loads or additional current sourcing elements.

One example of an approach employing a switched dummy load is shown in FIG. 11. FIG. 11 shows a conventional replica biased voltage regulator circuit in a schematic diagram designated by the general reference character 1100.

In the example of FIG. 11, a voltage regulator circuit 1100 can include a dummy load (Rdummy), which can be switched into the output path when an output voltage (Vpwr) exceeds a reference voltage (Vref). Conversely, dummy load (Rdummy) can be isolated from an output when the output voltage (Vpwr) falls below the reference voltage (Vref). In this way, switched dummy load (Rdummy) can regulate output voltage (Vpwr) to a particular range.

Alternatively, in order to prevent Vpwr from dropping under increased current load conditions, the inclusion of switched P-type devices have been proposed, as presented in FIG. 12 and U.S. Pat. No. 6,373,231, issued to Lacey et al. on Apr. 16, 2002.

In the example of FIG. 12, a voltage regulator circuit 1200 can include p-type switching device P1 in addition to a permanent dummy load Rdummy. When an output voltage (Vpwr) exceeds a reference voltage (Vref), p-type device P1 can be turned off reducing current supplied to load device (Vdummy) and thus lowering output voltage. Conversely, when the output voltage (Vpwr) falls below the reference voltage (Vref), p-type device P1 can be turned on, increasing current supplied to load device (Vdummy) and thus raising the output voltage (Vpwr). In this way, a switched current supply can regulate output voltage (Vpwr) to a particular range.

The above conventional arrangements can suffer from drawbacks. First, active load regulation (e.g., switching in of load device, or switching on of current supplies) is not a proportional response or timewise continuous. This means that regulation only happens during periods of time when the load current is either extremely low or extremely high, as opposed to load regulation taking place at all times. Since voltage comparators (Comp) are used, the regulation provided can be considered a "winner takes all" type of regulation, as opposed to having proportionality between load current variation and compensation current.

Second, conventional switching load regulation can have an undesirable lag in response. Even if fast comparators are used, current technologies cannot guarantee response times faster than 1–2 nanoseconds. This may be insufficient in certain applications (e.g., fast SRAMs). That is, this load regulation mechanism can work poorly in the high frequency domain (10 MHz–1 GHz), since even fast voltage comparator driven feedback loops still have a response time on the order of a few nanoseconds.

Third, the above arrangement requires deploying extra voltage comparators. This can increase operating current consumption.

In light of the above, it would be desirable to arrive at a voltage regulator that does not suffer from the above drawbacks of conventional approaches.

More particularly, it would be desirable to provide a replica biased voltage regulator having active (dynamic) load regulation and reduced output impedance in both the low and high frequency domains.

SUMMARY OF THE INVENTION

The present invention can include a voltage regulator circuit having a negative feedback loop that alters a supply current in response to a comparison between a replica voltage and a predetermined reference voltage. In addition, a current conveyor circuit can be coupled to a replica node and an output node and provide an output voltage. The current conveyor circuit can operate to force the replica voltage and output voltage to mirror one another.

The present invention can also include a voltage regulator circuit that includes a current conveyor circuit having replica leg that provides a replica voltage and an output leg, arranged in parallel with the replica leg, that provides a regulated output voltage. The replica leg and output leg can have cross coupled active devices that provide fast positive feedback for forcing the replica voltage and output voltage to essentially track one another. The voltage regulator circuit can further include at least one load supply transistor arranged in parallel with the output leg for providing a current to the output node that follows the current in the output leg.

The present invention can further include a voltage regulator circuit that includes a negative feedback loop that alters a current provided to a replica voltage node in response to differences between the replica voltage and a reference voltage to provide low frequency regulation of the replica voltage. In addition, the voltage regulator circuit can include a current conveyor circuit that includes a voltage mirror circuit that forces an output voltage to essentially follow the replica voltage to provide high frequency regulation of the output voltage.

BRIEF DESCRIPTION OF THE DRAWINGS

FIG. 1 is a schematic diagram of a voltage regulator according to a first embodiment.

FIG. 2 is a schematic diagram of a conventional voltage regulator circuit model.

DETAILED DESCRIPTION

Figure 3:
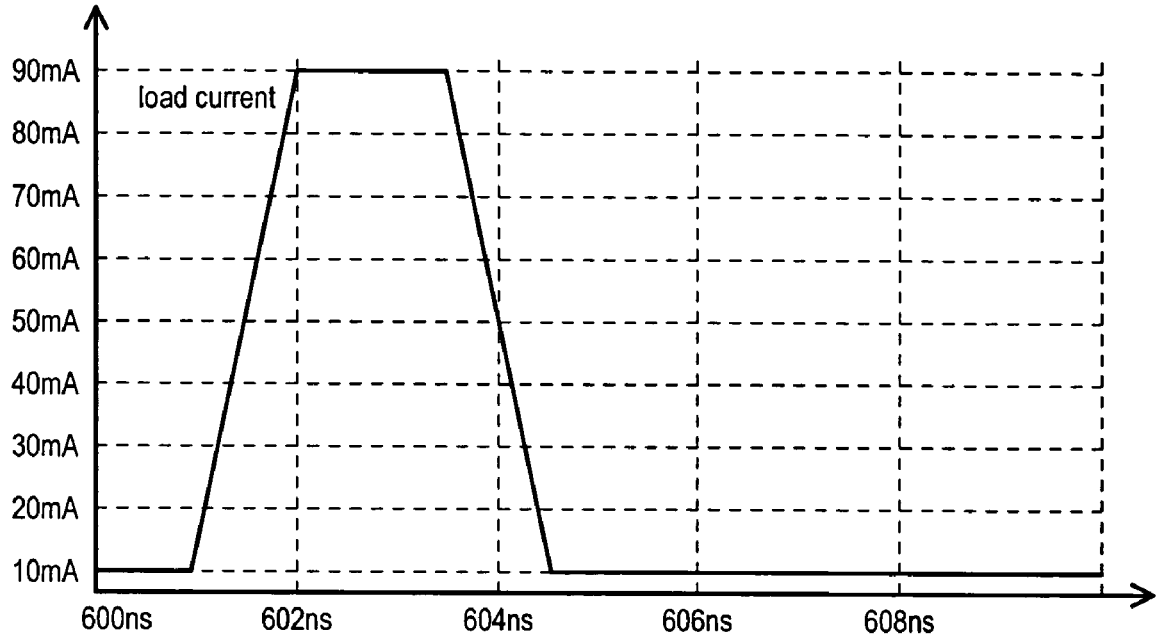
FIG. 3 is a timing diagram showing a waveform utilized to simulate the transient response of the circuits shown in FIGS. 1 and 2.

Various embodiments of the present invention will now be described in detail with reference to a number of drawings. The embodiments describe a replica biased voltage regulator that can provide continuous and proportional load regulation. In addition, such a voltage regulator can provide a quasi-instantaneous response to high-frequency load transients that can be superior to that of the conventional examples noted above.

A replica biased voltage regulator according to a first embodiment is set forth in FIG. 1 and designated by the general reference character 100. A voltage regulator 100 can include an amplifier 102, a supply section 104, a current conveyor 106, a replica load 108, a supplemental load supply 110, and a load 112. A replica voltage (Vrep) can be generated at one node Vnet5, while an output voltage (Vload) can be generated at a node Vnet6.

Amplifier 102 can be an operational amplifier that can serve in a negative feedback loop as will be described below. A noninverting input of amplifier 102 can receive a reference voltage (Vref) while an inverting input can receive a replica voltage (Vrep).

A supply section 104 can provide current to at least two different legs of voltage regulator 100. Such a current supply can be scaled so that the current provided for an output leg (N3/N5) can be larger than that of the replica leg (N4/N6). In the very particular example of FIG. 1, supply section 104 includes n-channel transistors N1 and N2 having drains connected to power supply voltage Vcc, and gates commonly connected to the output of amplifier 102. Transistor N1 can be scaled to be "n" times as large as transistor N2. That is, a size ratio for transistors N1:N2 can be n:1, where n is greater than 1. Transistor N2 can provide a current for a replica leg, while transistor N1 can provide a current for an output leg as well as supplemental load device 110.

A current conveyor 106 can provide a replica voltage (Vrep) on a replica leg and an output voltage (Vload) on an output leg. However, unlike conventional arrangements, such circuit legs are arranged as "voltage mirrors", with the replica voltage (Vrep) essentially being forced to track the output voltage (Vload), and vice versa.

In the very particular example of FIG. 1, current conveyor 106 can include n-type transistors N4 and N6 arranged in series with one another to form a replica leg, and transistors N3 and N5 arranged in series to provide an output leg. The gate of transistor N4 can be connected to its drain, the gate of transistor N6 can be connected to the drain of transistor N5, and the gate of transistor N5 can be connected to the drain of transistor N6. Thus, transistors N5 and N6 can be cross coupled with respect to one another. The replica voltage (Vrep) can be provided at the source of transistor N6 and the output voltage (Vload) can be provided at the source of transistor N5.

Transistors (N3, N4, N5, N6) of current conveyor 106 are preferably matched devices, having the same properties (e.g., threshold voltage) and same size. As will be described below in more detail, such an arrangement provides for rapid "positive feedback" response that forces Vrep=Vload.

A replica load 108 can generate a replica voltage (Vrep) according to a current supplied from replica leg (N4, N6). A replica load 108 is represented in FIG. 1 by resistor Rrep and capacitor Crep, in parallel, but could take alternate forms as understood by one skilled in the art.

Similarly, a load 112 can generate an output voltage (Vload) according to a current supplied from replica leg (N4, N6). An output load 112 is represented in FIG. 1 by capacitor Cload as well as nondepicted load resistance drawing current Iload.

A supplemental load supply 110 can provide current to output node (Vnet6), and can be sized to be proportional to devices in the output leg. More particularly, given a size ratio for N1:N2 of n:1, a ratio for N5:N7 can be 1:(n−1).

As noted above, an amplifier 102 can provide negative feedback with respect to replica voltage (Vrep). In particular, as the replica voltage (Vrep) falls below a reference voltage (Vref) an output voltage provided by amplifier 102 can increase, and additional current can flow through the replica leg, resulting in a higher replica voltage (Vrep). Conversely, as the replica voltage (Vrep) rises above a reference voltage (Vref), an output voltage provided by amplifier 102 can decrease, reducing current flowing through the replica leg, resulting in a lower replica voltage (Vrep).

The voltage mirroring effect of a current conveyor 106 according to the embodiment of FIG. 1 will now be described in more detail. It will be assumed that devices N3, N4, N5 and N6 are identical and have the same DC operating current. Thus, all devices N3–N6 have the same transconductance (gm3=gm4=gm5=gm6). Accordingly, the following relations hold:

$$gm3*(V\text{net}2-V\text{net}3)=gm5*(V\text{net}4-V\text{load}) \quad (1)$$

$$gm4*(V\text{net}2-V\text{net}4)=gm6*(V\text{net}3-V\text{rep}) \quad (2)$$

$$V\text{net}2-V\text{net}3=V\text{net}4-V\text{load} \quad (3)$$

$$V\text{net}2-V\text{net}4=V\text{net}3-V\text{rep} \quad (4)$$

$$\text{Vload}=\text{Vrep} \quad (5)$$

Therefore, because of the connection of the gates of N3, N4 to node Vnet2, the current conveyor 106 forces the output voltage (Vload) to be equal to the replica voltage (Vrep), and vice-versa, in the AC small signal domain. At the same time, however, replica voltage (Vrep) should be kept essentially constant, either by the negative feedback loop, if within the unity gain bandwidth of amplifier 102, or by capacitor Crep, if beyond it. In this way, the circuit conveyor 106 can transfer the low output impedance, from the replica to the load.

Because the output capability of the circuit (e.g., Iload) is higher than the replica current within replica leg (N4, N6), transistor N7 can take over any extra load current needed. Such an arrangement is possible due the sizing of transistors, as noted above, (e.g., N1 and N2 scaled n:1, while N7 and N3–N6 are scaled (n−1):1).

Accordingly, due to the operation of current conveyor 106, a variation of output voltage (Vload) is going to produce a similar variation in replica voltage (Vrep), which is then going to be corrected for by the line regulation negative feedback loop noted above. Looked at in another way, load regulation can be provided by transferring the output voltage (Vload) information to the negative feedback loop. Thus, if a load current (Iload) increases and Vload drops, this leads to a drop in the voltage at node Vnet3, followed by a drop in replica voltage (Vrep). Such a drop causes an increase in the voltage on the gates of N1, N2 and a subsequent correction of the output voltage (Vload).

The response of the voltage regulator circuit according to the embodiment of FIG. 1, may be further understood with a more detailed analysis. A more detailed analysis yields the following output impedance formula:

$$Z_{out}(s) = \frac{1}{na_0 g_m} * \frac{1 * \frac{s}{\varpi_0}}{\left(1 + \frac{s}{a_0\varpi_0}\right)\left(1 + \frac{s}{\varpi_1}\right)\left(1 + \frac{s}{\varpi_2}\right)}, \tag{6}$$

where:

$g_m$ is the transconductance of transistors N3–N6

$a_0$ is the gain of the amplifier 102

$\overline{\omega}_0 = 2\pi f_0$, where $f_0$ is the cutoff frequency of the operational amplifier $\overline{\omega}_1 = g_m/C_{rep}$ $\overline{\omega}_2 = na_0 g_m/C_{load}$ In light of the above analysis, in order to minimize the output impedance, it would be desirable to use large-bandwidth current conveyor transistors and operational amplifiers (increase $\alpha_0\overline{\omega}_0$), as well as large replica load capacitance (Crep) values (decrease $\overline{\omega}_1$). A modest DC gain, of about 30 dB, can be sufficient for the wide band operational amplifier. The load capacitance Cload introduces its own pole in the output impedance expression, helping the high frequency transient response.

In one particular implementation, the operational amplifier 102 unity-gain bandwidth is 55 MHz, while the gain is 28 dB.

Referring still to the embodiment of FIG. 1, in the low and medium frequency domain, output impedance drops by a factor $a_0$ with respect to the output impedance of a conventional replica biased voltage regulator, like that described above.

Beyond the loop unity gain bandwidth ($a_0\overline{\omega}_0$) the output impedance levels off and then it drops due to the poles introduced by the replica branch capacitor ($\overline{\omega}$1) and the load capacitor ($\overline{\omega}$2).

Therefore, as previously noted, in order to minimize Zout(s) up to as high a frequency as possible, we need to use large bandwidth operational amplifiers (increase $a_0\overline{\omega}_0$) and large replica branch capacitor (decrease $\overline{\omega}$1). Of course, an increased load capacitor can help with handling fast current transients (decrease $\overline{\omega}_2$).

Figure 11:
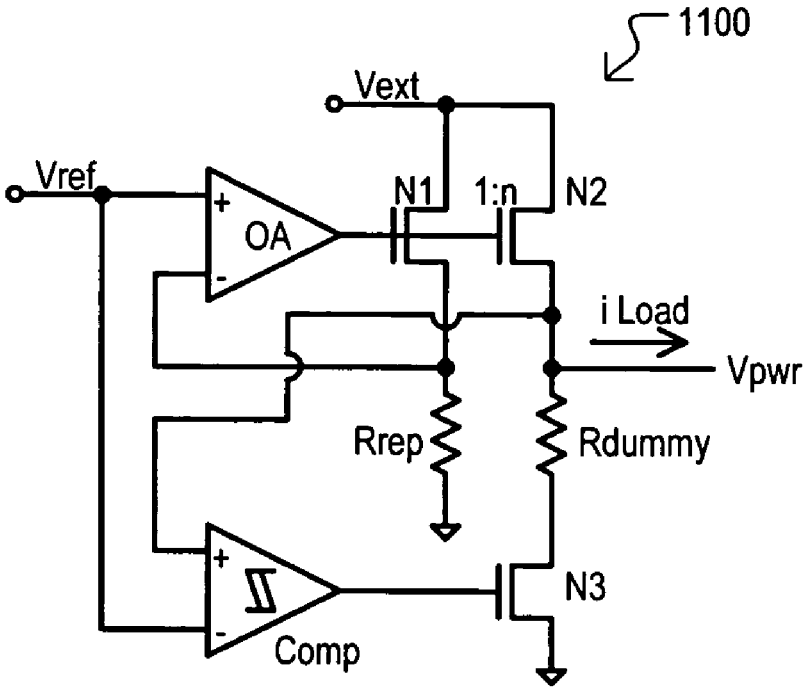
FIG. 11 (BACKGROUND ART)
FIG. 11 is a schematic diagram of a first conventional voltage regulator circuit.
Figure 12:
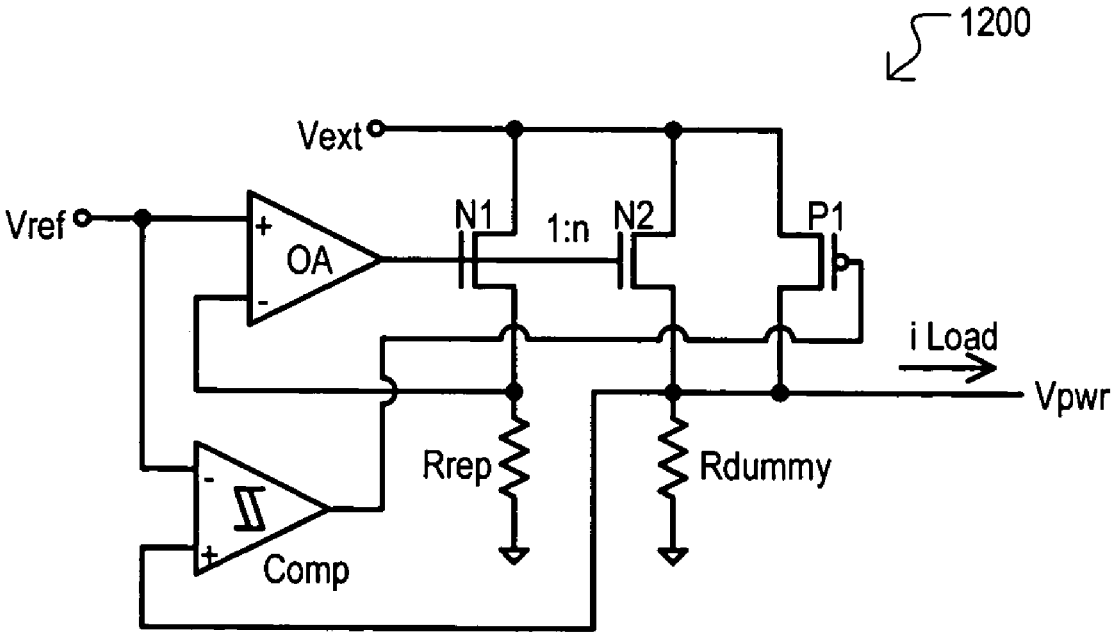
FIG. 12 (BACKGROUND ART)
FIG. 12 is a schematic diagram of a second conventional voltage regulator circuit.

The embodiment set forth in FIG. 1 can have several advantages over conventional arrangements, like those described above in FIGS. 11 and 12.

In particular, the voltage regulator 100 does not involve a second feedback loop. This can result in smaller current consumption than conventional arrangements. This can make the voltage regulator 100 applicable to mobile applications which typically seek lower current and/or power consuming devices.

Further, a voltage regulator 100 has only one negative feedback loop. This can eliminate stability issues that can arise due to loop-to-loop coupling.

In addition, in the voltage regulator 100, local positive feedback in the current conveyor is extremely fast, allowing for essentially instantaneous response to high frequency transients. This is in contrast to conventional arrangements that can introduce operational amplifier response delay.

The embodiment disclosed can thus address the shortcomings of existing solutions listed above in the BACKGROUND OF INVENTION. More particularly, the embodiment of FIG. 1 includes: continuous and proportional load regulation by virtue of the load voltage information being transferred to the linear negative feedback loop; good high frequency response, courtesy of the local positive feedback; and reduced current consumption, since no additional amplifiers (e.g., comparators) are needed.

One particular set of results is presented in the Table 1 below to illustrate the load regulation feature of the first embodiment. The example indicates a case in which a reference voltage has been set to 1.300V.

TABLE 1

| | Corner (Conditions) | | | | | |
|---|---|---|---|---|---|---|
| | Old circuit output voltage (FIG. 2) | | | New circuit output voltage (FIG. 1) | | |
| | Load current | | | | | |
| | 3 mA | 30 Ma | 60 mA | 3 mA | 30 mA | 60 mA |
| 2.9 V/140° C. | 1.501 V | 1.315 V | 1.199 V | 1.343 V | 1.313 V | 1.301 V |
| 3.7 V/140° C. | 1.510 V | 1.326 V | 1.211 V | 1.353 V | 1.324 V | 1.313 V |
| 2.9 V/−40° C. | 1.448 V | 1.308 V | 1.221 V | 1.327 V | 1.308 V | 1.303 V |
| 3.7 V/−40° C. | 1.451 V | 1.313 V | 1.228 V | 1.331 V | 1.314 V | 1.310 V |

Table 1 shows how the example of FIG. 1 can provide advantageously better regulation than a conventional model shown in FIG. 2.

In order to simulate transient behavior, a simulation was conducted with a pulsed current waveform having a DC component of 10 mA and peak value of 90 mA. As will be shown in more detail below, the voltage regulator of the embodiment of FIG. 1 produced an output drop decrease from 130 mV peak-to-peak (for the case of FIG. 1) to 60 mV peak-to-peak. Such conditions were compared to a model representing one particular conventional voltage regulator shown in FIG. 2.

FIG. 3 is a timing diagram that shows a load current (Iload) waveform utilized to simulate a transient response.

Figure 4:
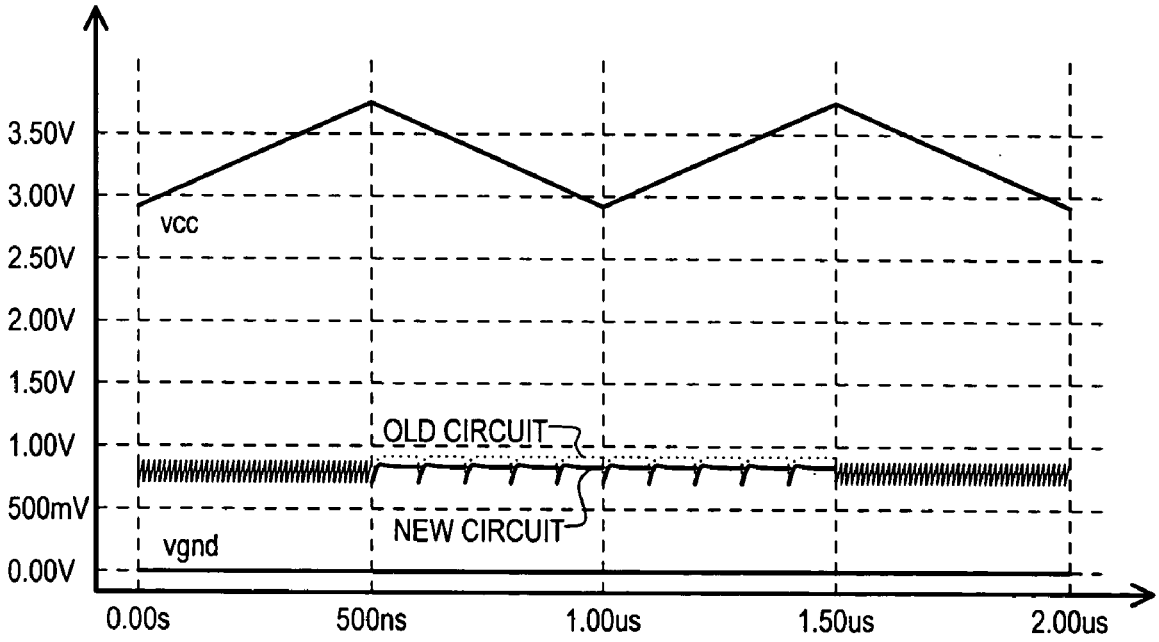
FIG. 4 is a timing diagram showing a comparative response between the circuits of FIG. 1 and the circuit of FIG. 2.

FIG. 4 is a timing diagram showing a power supply response (Vcc) and an output voltage (Vpwr) for both the conventional case of FIG. 2 ("OLD CIRCUIT") as well as that of FIG. 1 ("NEW CIRCUIT").

Figure 5:
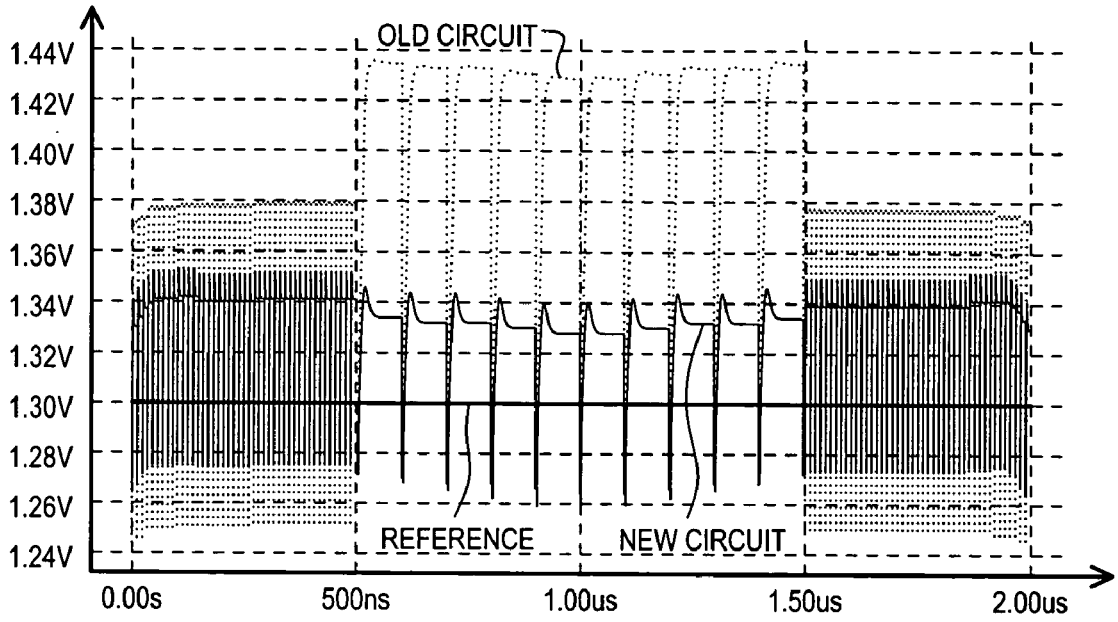
FIG. 5 shows a section of FIG. 4.

FIG. 5 is a section of the Vpwr responses of FIG. 4, expanded along the vertical axis (voltage). This view also shows an input reference voltage "REFERENCE", which can correspond to reference voltage (Vref) of FIGS. 1 and 2.

Figure 6:
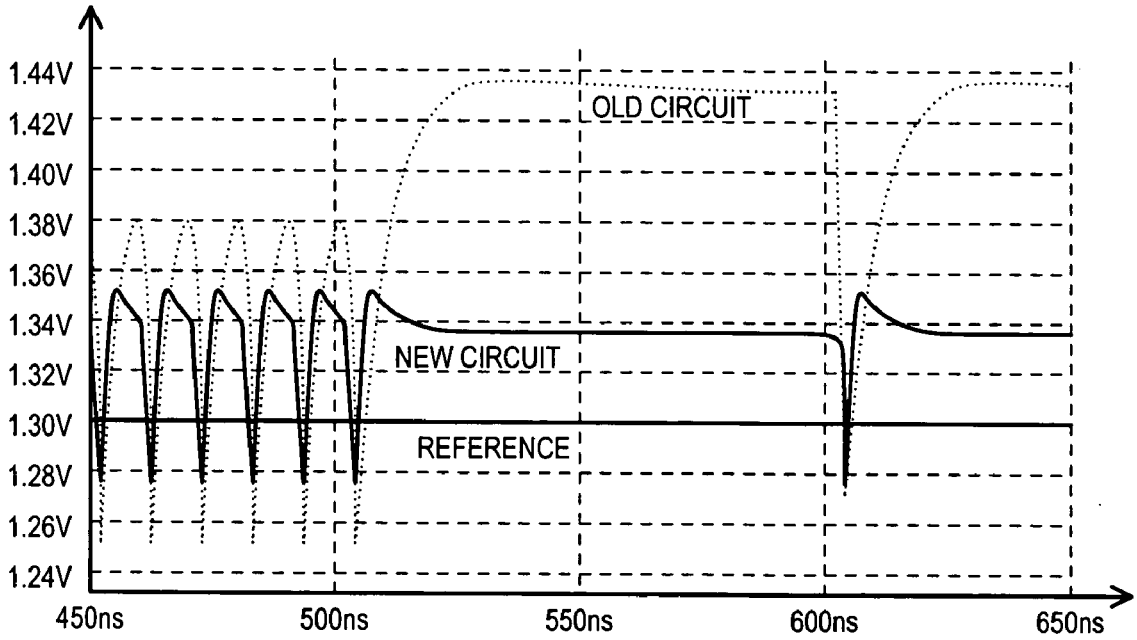
FIG. 6 shows a section of FIG. 5.
Figure 7:
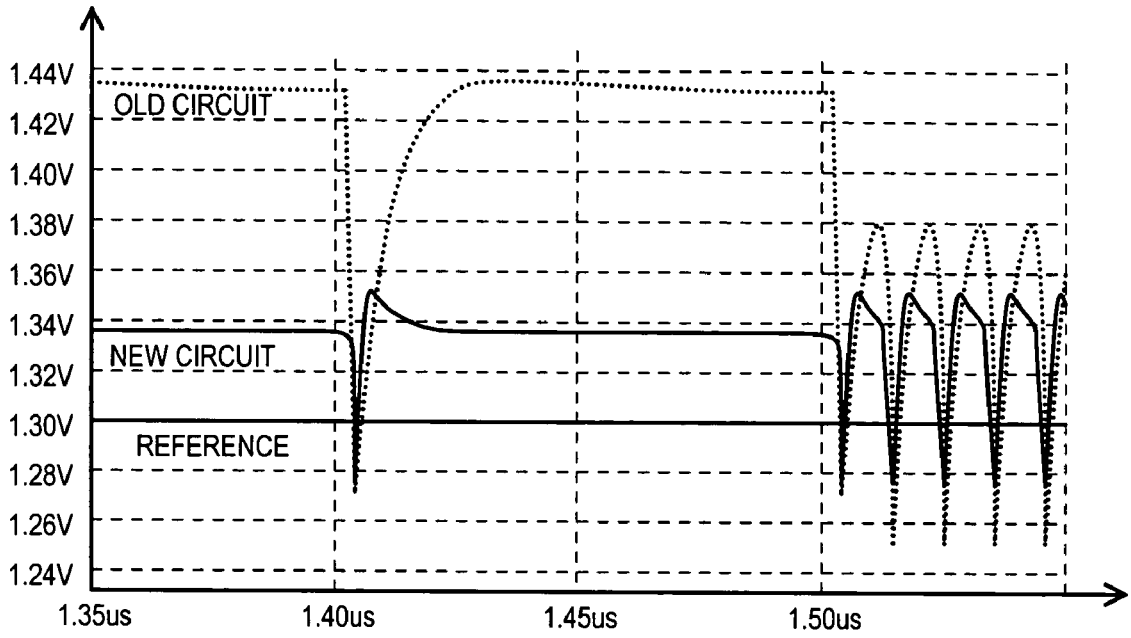
FIG. 7 shows another section of FIG. 5.

FIG. 6 is a section of the Vpwr responses of FIG. 5, expanded along the horizontal axis (time). FIG. 7 shows another section of the Vpwr responses of FIG. 5, expanded along the horizontal axis (time), along with the reference voltage input (Vref). FIGS. 6 and 7 also clearly show the reduction in peak-to-peak voltage from about 130 mV ("old circuit") to about 60 mV ("new circuit").

Figure 8:
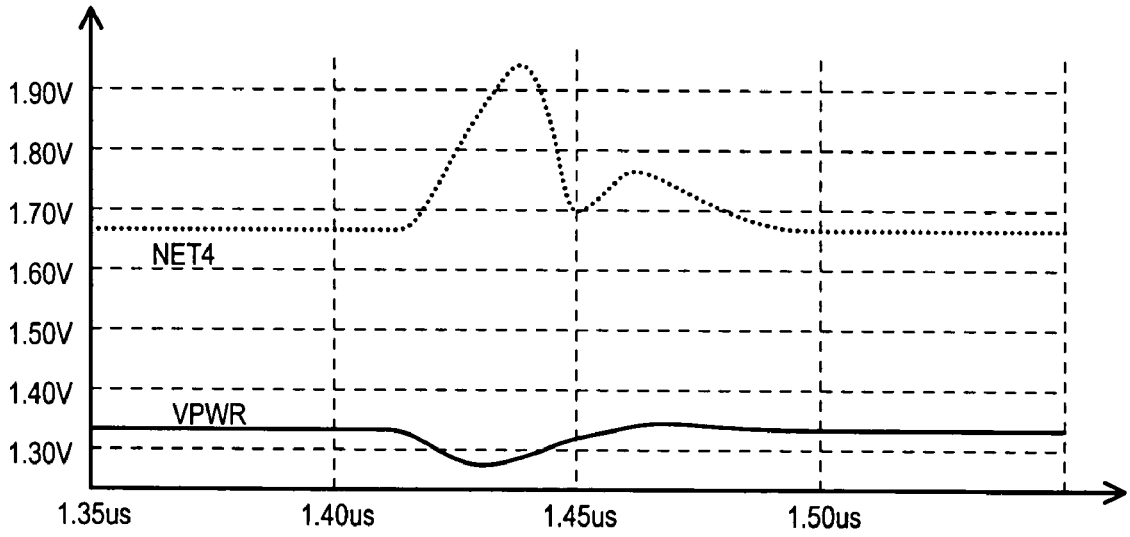
FIG. 8 shows an instantaneous response of a node Vnet4 in the circuit shown in FIG. 1.

FIG. 8 shows instantaneous response of node "Vnet4" in the current conveyor 106 to a drop in the load voltage (Vload) caused by the high frequency transient of the comparative simulations of FIGS. 3–7. FIG. 8 also shows the output voltage (Vpwr).

Figure 9:
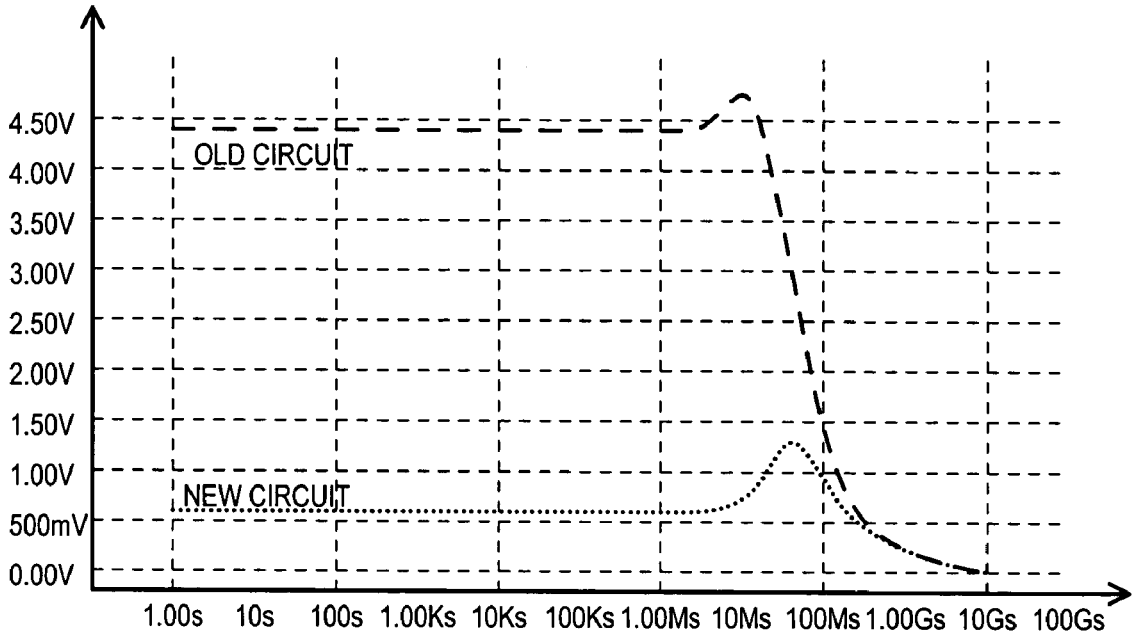
FIG. 9 is a graph showing the output impedance of the circuit of FIG. 1 versus the circuit of FIG. 2.

FIG. 9 comparatively shows the new circuit (FIG. 1) versus old circuit (FIG. 2) output impedance curves in the frequency domain. It is noted that the about 65% drop in high frequency output impedance accurately matches the 65% reduction in the HF output ripple presented in FIGS. 6 and 7.

It is noted that in the embodiment of FIG. 1, a certain voltage "overhead" may be needed to accommodate the series connected transistors of the current conveyor 106. That is, a minimum voltage difference between the drains of transistors N2/N1 and the sources of transistors N5/N6 may be needed. If normal n-channel transistor threshold voltages are too large, the extra necessary voltage overhead can be compensated for by using native devices, either in the n-type followers of current supply section 104 (N1, N2) or in the current conveyor N3–N7. In addition or alternatively, the gates of the N-type followers can be "pumped" by applying a voltage higher than a supply voltage Vcc.

While the embodiment of FIG. 1 can provide for improved voltage regulation, in some applications such regulation may only be needed in particular modes. One example of a circuit that can disable high speed transient responses is shown FIG. 10.

Figure 10:
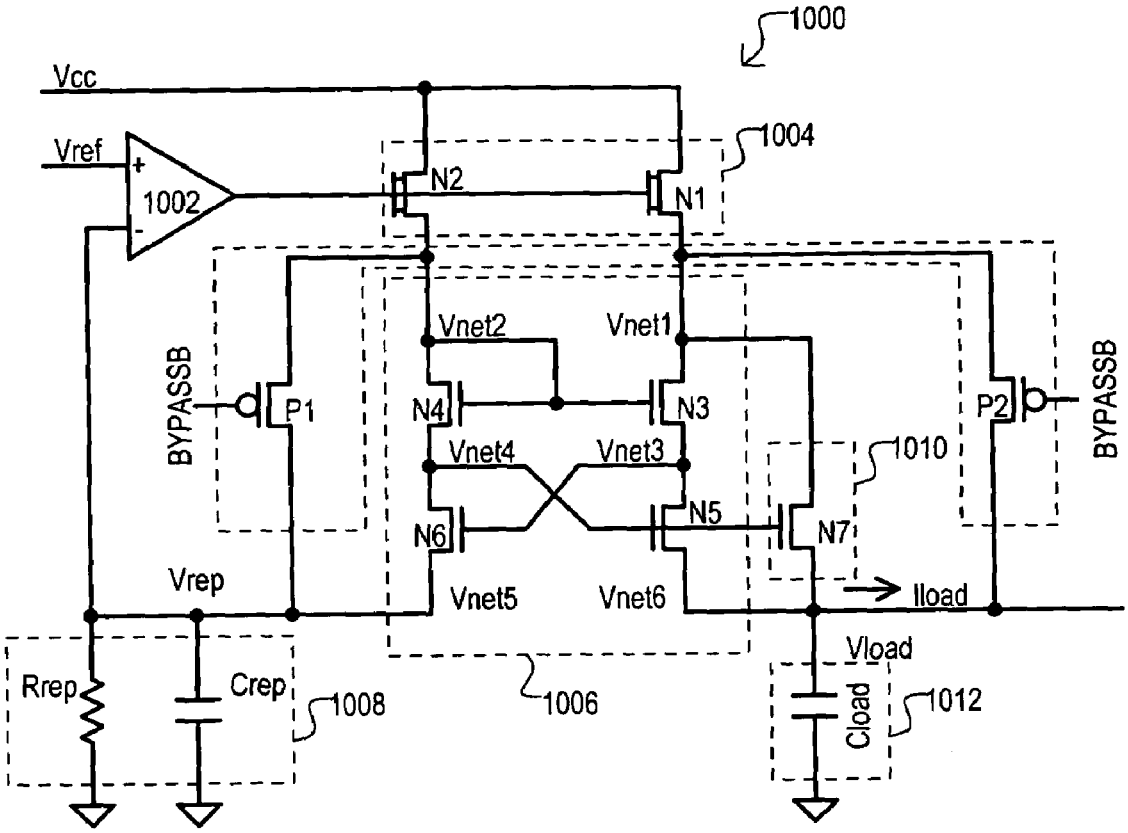
FIG. 10 is schematic diagram of another embodiment of the present invention.

A second embodiment is set forth in FIG. 10, and designated by the general reference character 1000. A second embodiment 10 can include the same general components as the first embodiment of FIG. 1, so like sections will be referred to by the same reference character but with the first digit being a "10" instead of a "1".

In the arrangement of FIG. 10, a current conveyor 1006 can be essentially bypassed, effectively reverting the voltage regulator 1000 to existing designs (e.g., model of FIG. 2). As shown, p-type transistor P1 and P2 switches can be used to this effect. When the signal BYPASSB transitions low, transistors P1 and P2 can turn on, short circuiting the current conveyor 1006 as well as the supplemental load supply 1010.

Such a feature may be advantageously employed to reduce current consumption in modes where regulation may not be required. As but one example, in a memory application, tight regulation may not be required in a low power data retention mode.

It is understood that the example of FIG. 1 is but one embodiment of the present invention and should not be construed as limiting the invention thereto. For example, while an operational amplifier 102 can be a 2-stage circuit, optimizing such an operational amplifier could result in better results.

Accordingly, while the various aspects of the particular embodiments set forth herein have been described in detail, the present invention could be subject to various changes, substitutions, and alterations without departing from the spirit and scope of the invention.

The invention claimed is:

1. A voltage regulator circuit, comprising:

a negative feedback loop that alters a supply current in response to a comparison between a replica voltage and a predetermined reference voltage; and a current conveyor circuit coupled to a replica node that provides the replica voltage and an output voltage at an output node, the current conveyor circuit operating to force the replica voltage and output voltage to mirror one another.

2. The voltage regulator circuit of claim 1, wherein:

the current conveyor circuit includes a replica leg coupled to the replica node in parallel with an output leg coupled to the output node.

3. The voltage regulator circuit of claim 2, wherein:

the replica leg comprises at least two transistors having source drain paths arranged in series, the gate of at least one transistor being coupled to the output leg, and the output leg comprises at least two transistors having source drain paths arranged in series, the gate of at least one transistor being coupled to the replica leg.

4. The voltage regulator of claim 3, wherein:

the replica leg comprises a first n-channel transistor having a gate coupled to its drain, a second n-channel transistor having drain coupled to the source of the first n-channel transistor and a source coupled to the replica node, and the output leg comprises a third n-channel transistor having a gate coupled to the drain of the first n-channel transistor, a fourth n-channel transistor having a drain coupled to the source of the third n-channel transistor, a gate coupled to the drain of the second n-channel transistor, and a source coupled to output node; wherein the first, second, third, and fourth transistors match one another.

5. The voltage regulator of claim 1, further including:

a supply section that provides current to the current conveyor circuit in response to the negative feedback loop.

6. The voltage regulator of claim 5, wherein:

the current conveyor circuit includes at least first and second transistors arranged in series to form a replica leg, and at least third and fourth transistors arranged in series to form an output leg; and the supply section comprises at least a first supply transistor having a source drain path in series with the replica leg and a gate coupled to the negative feedback loop, and at least a second supply transistor having a source drain path in series with the output leg and a gate coupled to the negative feedback loop.

7. The voltage regulator of claim 6, wherein:

the first and second supply transistors have a lower threshold voltage than the first, second, third, and fourth transistors of the current conveyor.

8. The voltage regulator of claim 6, wherein:

the first and second supply transistors have drains coupled to a high supply voltages and receive a pumped voltage higher than the high supply voltage at their respective gates.

9. The voltage regulator of claim 6, further including:

the first, second, third and fourth transistors of the current conveyor circuit having first size;

the first supply transistor of the supply section is of the first size;

the second supply transistor of the supply section has a second size that is n times greater than the first size; and a load supply transistors having a source drain path in parallel with the output leg having a size that is (n−1) times greater than the first size.

10. A voltage regulator circuit comprising:

a current conveyor circuit having replica leg that provides a replica voltage and an output leg arranged in parallel with the replica leg that provides a regulated output voltage, the replica leg and output leg having cross coupled active devices that provide positive feedback for forcing the replica voltage and output voltage to essentially track one another; and at least one load supply transistor arranged in parallel with the output leg for providing a current to the output node that follows the current in the output leg.

11. The voltage regulator circuit of claim 10, wherein:

the replica leg comprises a first transistor having a drain connected to a source of a second transistor, the output leg comprises a third transistor arranged in series with a fourth transistor, the fourth transistor and at least one load supply transistor have gates coupled to the source-drain connection between the first and second transistors.

12. The voltage regulator circuit of claim 10, further including:

a current supply section with at least a first current supply device that provides current to the replica leg, and a second current supply device that provides current to the output leg and the at least one load supply transistor; and an operational amplifier having a output coupled to the current supply section, a noninverting input coupled to a reference voltage and an inverting input coupled to the replica node.

13. The voltage regulator circuit of claim 10, further including:

a first bypass device in parallel with the replica leg that provides a low impedance path when enabled for bypassing the operation of the replica leg, and a second bypass device in parallel with the output leg that provides a low impedance path when enabled for bypassing the operation of the output leg.

14. The voltage regulator circuit of claim 13, wherein:

the voltage regulator circuit provides a power supply voltage to a memory cell array; and the first bypass device and second bypass device are enabled in a data retention mode.

15. A voltage regulator circuit, comprising:

a negative feedback loop that alters a current provided to a replica node in response to differences between the replica node voltage and a reference voltage to provide low frequency regulation of the replica node voltage; and a current conveyor circuit that includes a voltage mirror circuit that forces an output node voltage to essentially follow the replica node voltage to provide high frequency regulation of the output node voltage.

16. The voltage regulator circuit of claim 15, wherein:

the voltage mirror circuit includes a replica leg comprising at least a first transistor having a gate coupled to its drain and a second transistor having a drain coupled to the source of the first transistor and a drain coupled to the replica node, and an output leg comprising at least a third transistor having a gate coupled to the gate of the first transistor and a fourth transistor having a drain coupled to the source of the third transistor and to the gate of the second transistor, a gate coupled to the drain of the second transistor, and a drain coupled to the output node.

17. The voltage regulator circuit of claim 15, wherein:

the current conveyor comprises no more than four transistors.

18. The voltage regulator circuit of claim 15, further including:

the negative feedback loop includes an operational amplifier having an amplifier output, a current supply section that adjusts current provided to the current conveyor based on the output of the operational amplifier, a replica leg comprising at least two transistors having source drain paths arranged in series, and a replica load for generating the replica node voltage based on a current provided by the replica leg, wherein the operational amplifier has an inverting input coupled to the s replica load and a noninverting input is coupled to a reference voltage.

19. The voltage regulator circuit of claim 16, wherein:

two of the first, second, third or fourth transistors have lower threshold voltages than the other transistors.

20. The voltage regulator circuit of claim 15, further including:

the current conveyor includes a replica leg that provides a current to the replica node in parallel with an output leg that provides a current to an output node; and a load supply device in parallel with the output leg that provides a current proportional to the current provided by the output leg.

* * * * *